US011185154B2

(12) United States Patent
Wu et al.

(10) Patent No.: US 11,185,154 B2
(45) Date of Patent: Nov. 30, 2021

(54) BRUSHING SPRAYER

(71) Applicant: Purity (Xiamen) Sanitary Ware Co., Ltd., Xiamen (CN)

(72) Inventors: James Wu, Taichung (TW); Alex Wu, Taichung (TW); Ce-Wen Yang, Xiamen (CN)

(73) Assignee: PURITY (XIAMEN) SANITARY WARE CO., LTD., Fujian (CN)

( * ) Notice: Subject to any disclaimer, the term of this patent is extended or adjusted under 35 U.S.C. 154(b) by 304 days.

(21) Appl. No.: 16/516,861

(22) Filed: Jul. 19, 2019

(65) Prior Publication Data

US 2021/0015247 A1 Jan. 21, 2021

(51) Int. Cl.

| | |
|---|---|
| ***A46B 13/00*** | (2006.01) |
| ***A46B 13/04*** | (2006.01) |
| ***A46B 11/06*** | (2006.01) |
| *A47L 17/00* | (2006.01) |

(52) U.S. Cl.

CPC ..... *A46B 13/001* (2013.01); *A46B 11/063* (2013.01); *A46B 13/04* (2013.01); *A46B 2200/3033* (2013.01); *A47L 17/00* (2013.01)

(58) Field of Classification Search

CPC ..... B60S 3/04; B60S 3/048; A46B 13/001; A46B 11/063; A46B 13/04; A46B 13/06; A46B 2200/3033; A46B 11/06; B05B 1/12; B05B 1/16; B05B 1/1654; B05B 1/18; B05B 1/1636; B05B 1/1618; B05B 1/1609; F16K 11/20; F16K 27/04

See application file for complete search history.

(56) References Cited

U.S. PATENT DOCUMENTS

| | | | | |
|---|---|---|---|---|
| 2006/0242774 | A1* | 11/2006 | Schmid | A46B 13/008 15/29 |
| 2012/0090106 | A1* | 4/2012 | Jaeger | A46B 13/06 15/21.1 |
| 2016/0136659 | A1* | 5/2016 | Erickson | F16K 11/20 239/443 |

* cited by examiner

*Primary Examiner* — Katina N. Henson

(74) *Attorney, Agent, or Firm* — Birch, Stewart, Kolasch & Birch, LLP

(57) ABSTRACT

A brushing sprayer includes a pipe body, a diverter, a control assembly and a brushing head. A pipe body includes an inlet end and an outlet opening communicating with each other. A diverter is positioned in the pipe body, and includes a first flow way, a second flow way and a third flow way communicating with each other and communicating with the inlet end and the outlet end of the pipe body. A control assembly passes through the pipe body, and is connected to the diverter. The control assembly is adapted to plug two selected from the group consisting of the first flow way, the second flow way and the third flow way, whereby a water flow could be regulated by the control assembly to outlet from the first flow way, the second flow way or the third flow way. The brushing head is positioned on the outlet end of the pipe body.

18 Claims, 21 Drawing Sheets

BRUSHING SPRAYER

BACKGROUND OF THE INVENTION

1. Technical Field

The present disclosure relates generally to a sprayer, and more particularly to a brushing sprayer.

2. Description of Related Art

Generally, a conventional sprayer for kitchen cleaning is usually only a nozzle connected to a faucet, which can only provide a single flushing function. Therefore, if a user needs other water outlet functions, the sprayer needs to be replaced by another sprayer, which causes inconvenience in use.

In addition, when cleaning relatively greasy tableware, the user usually needs to place the tableware under the sprayer, and washes the tableware with a tool such as a melon cloth or a brush at the same time. However, the sprayer cannot be adjusted according to the blind position of the tableware. Therefore, the user usually needs to rinse while brushing, which not only wastes time for washing the dishes, but also increases the waste of water.

At least for the above reasons, the conventional sprayer for rinsing still have room for improvements.

BRIEF SUMMARY OF THE INVENTION

In view of the above, the primary objective of the present disclosure is to provide a brushing sprayer. The brushing sprayer provides multiple flushing functions, and includes a brushing head, so that the user could save time for washing the dishes, and could decrease the waste of water. Furthermore, the brushing sprayer is more convenient in use compared to conventional sprayers for kitchen cleaning.

The present disclosure provides a brushing sprayer. The brushing sprayer includes a pipe body, a diverter, a control assembly and a brushing head. The a pipe body increases an inlet end and an outlet opening, wherein the inlet end has an inlet opening, and the outlet end has a first outlet opening, a second outlet opening and a third outlet opening. The inlet opening, the first outlet opening, the second outlet opening and the third outlet opening communicate with each other. The diverter is positioned in the pipe body, and comprising a first flow way, a second flow way and a third flow way communicating with each other, wherein the first flow way, the second flow way and the third flow way communicate with the inlet opening, the first outlet opening, the second outlet opening and the third outlet opening. A control assembly passes through the pipe body, and is connected to the diverter. The control assembly is adapted to plug two selected from the group consisting of the first flow way, the second flow way and the third flow way, whereby a water flow could be regulated by the control assembly to outlet from the first flow way, the second flow way or the third flow way. A brushing head is positioned on the outlet end of the pipe body.

With the aforementioned design, the brushing sprayer provides multiple flushing functions, and includes a brushing head, so that the user could save time for washing the dishes, and could decrease the waste of water. Furthermore, the brushing sprayer is more convenient in use compared to conventional sprayers for kitchen cleaning.

BRIEF DESCRIPTION OF THE SEVERAL VIEWS OF THE DRAWINGS

The present disclosure will be best understood by referring to the following detailed description of some illustrative embodiments in conjunction with the accompanying drawings, in which.

DETAILED DESCRIPTION OF THE INVENTION

Figure 1:
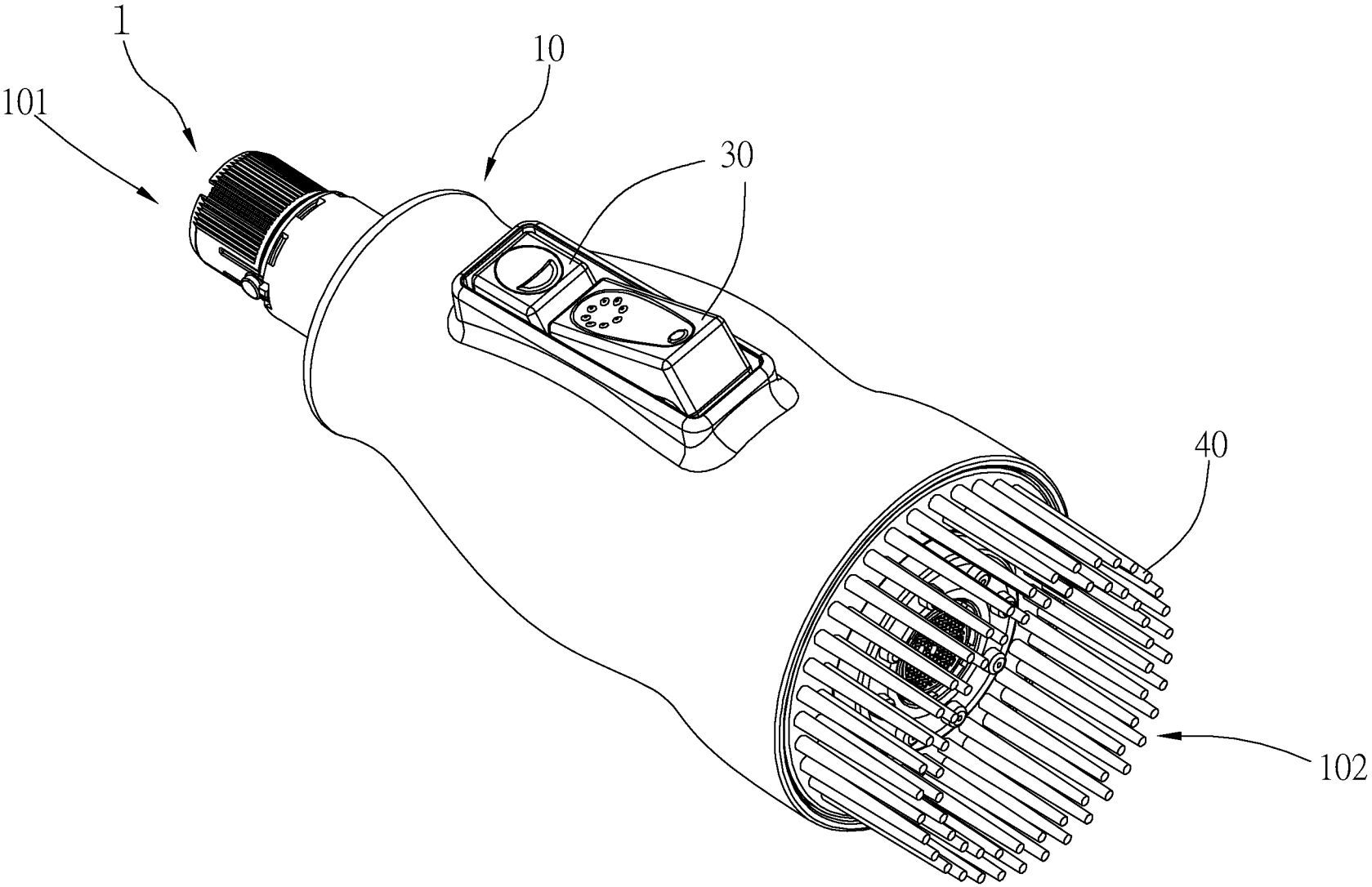
FIG. 1 is a perspective view of a brushing sprayer of one embodiment of the present disclosure.
Figure 2:
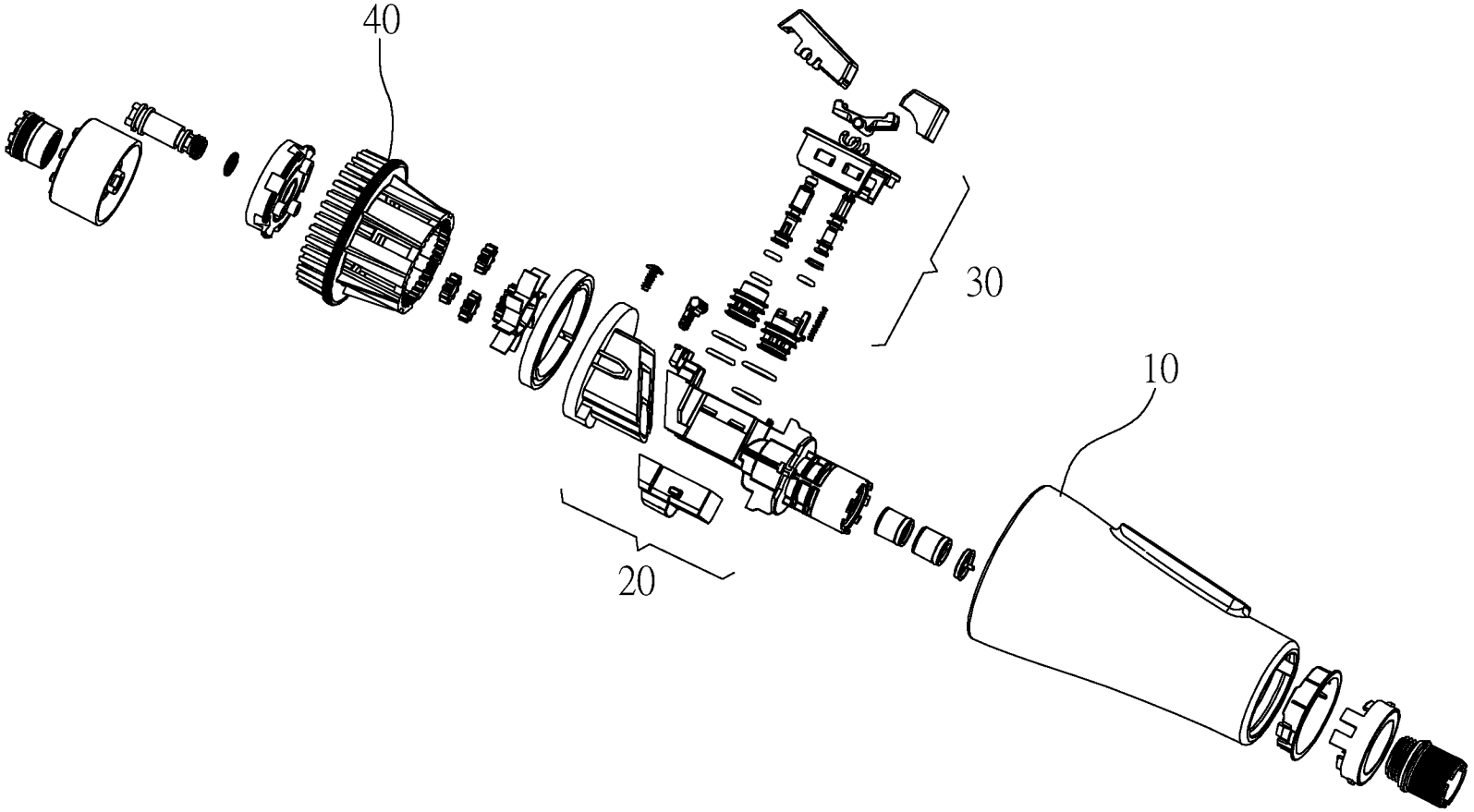
FIG. 2 is an exploded view of the brushing sprayer of one embodiment of the present disclosure.

As illustrated in FIG. 1 to FIG. 11, a brushing sprayer 1 is provided. The brushing sprayer includes a pipe body 10, a diverter 20, a control assembly 30 and a brushing head 40.

The pipe body 10 includes an inlet end 101 and an outlet opening 102, wherein the inlet end 101 has an inlet opening 101*a*, and the outlet end 102 has a first outlet opening 102*a*, a second outlet opening 102*b* and a third outlet opening 102*c*. According to one embodiment of the present disclosure, the inlet opening 101*a*, the first outlet opening 102*a*, the second outlet opening 102*b* and the third outlet opening 102*c* communicate with each other.

The diverter 20 is positioned in the pipe body 10, and includes a first flow way 201, a second flow way 202 and a third flow way 203 communicating with each other. According to one embodiment of the present disclosure, the first flow way 201, the second flow way 202 and the third flow way 203 communicate with the inlet opening 101*a*, the first outlet opening 102*a*, the second outlet opening 102*b* and the third outlet opening 102*c*.

The control assembly 30 passes through the pipe body 10, and is connected to the diverter 20. According to one embodiment of the present disclosure, the control assembly 30 is adapted to plug two selected from the group consisting of the first flow way 201, the second flow way 202 and the third flow way 203, whereby a water flow F1, F2 or F3 could be regulated by the control assembly 30 to outlet from the first flow way 201, the second flow way 202 or the third flow way 203.

Figure 3A:
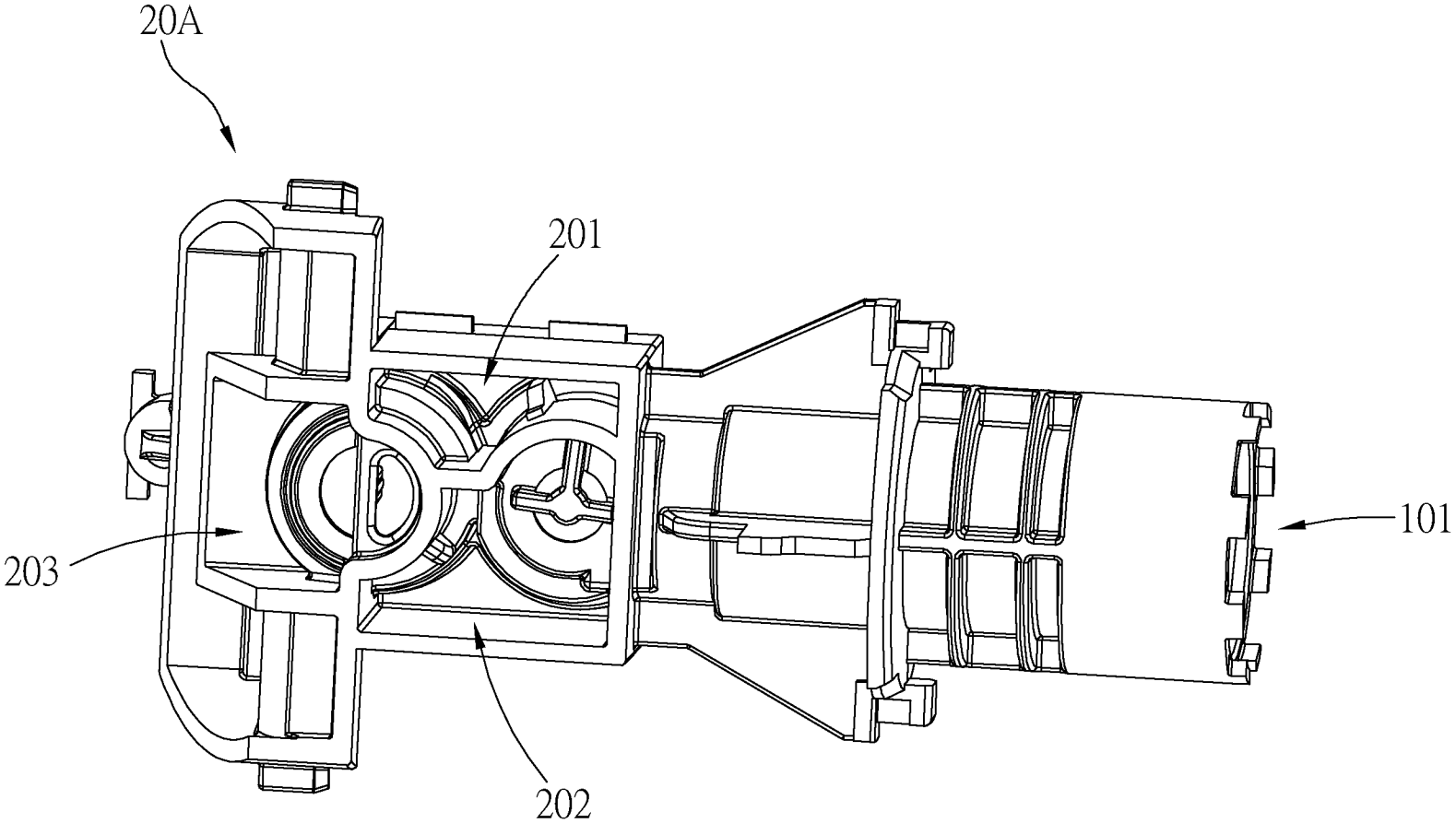
FIG. 3A is a partial cross-sectional view of a diverter of the brushing sprayer of one embodiment of the present disclosure.
Figure 3B:
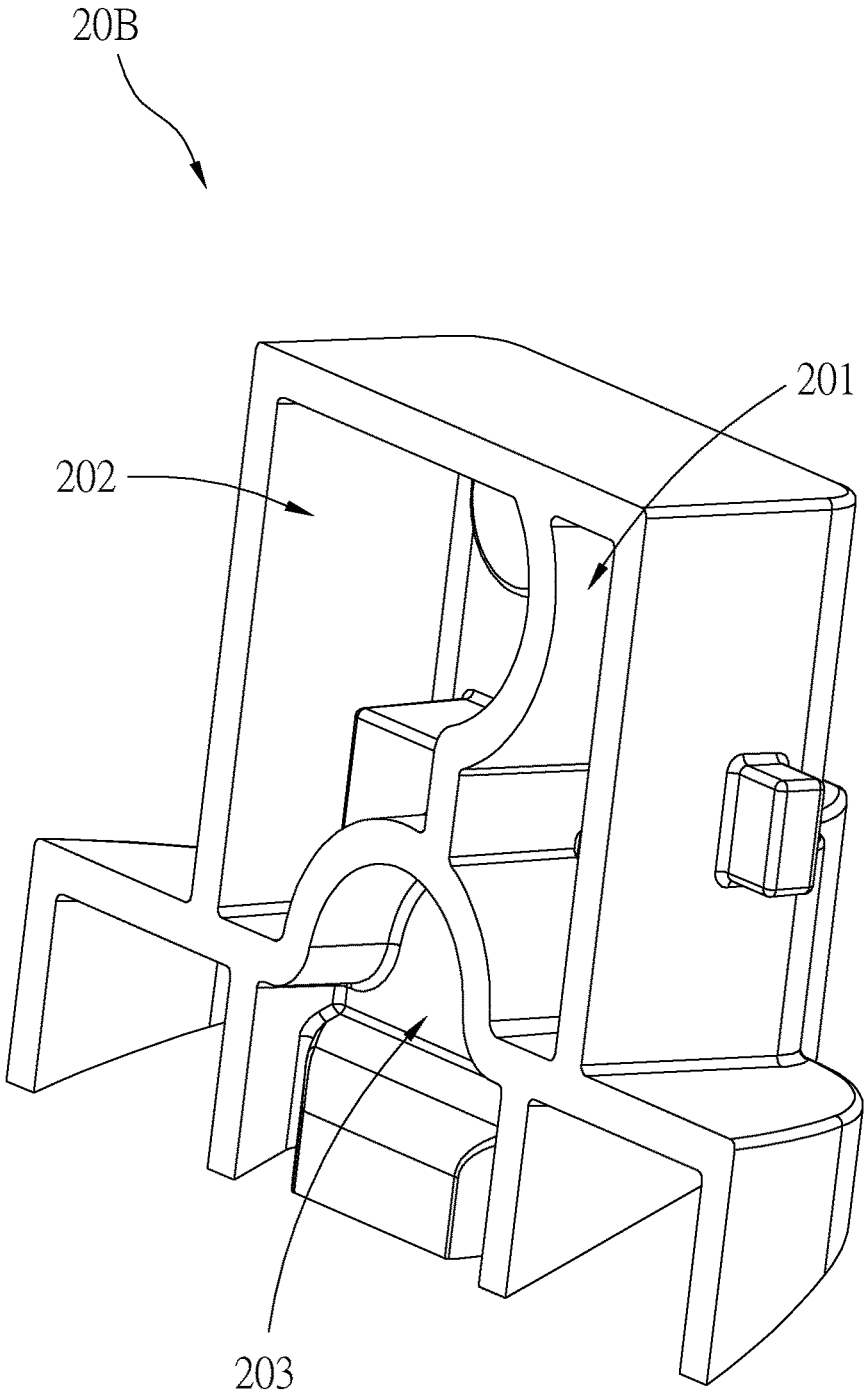
FIG. 3B is a partial cross-sectional view of the diverter of the brushing sprayer of one embodiment of the present disclosure.
Figure 3C:
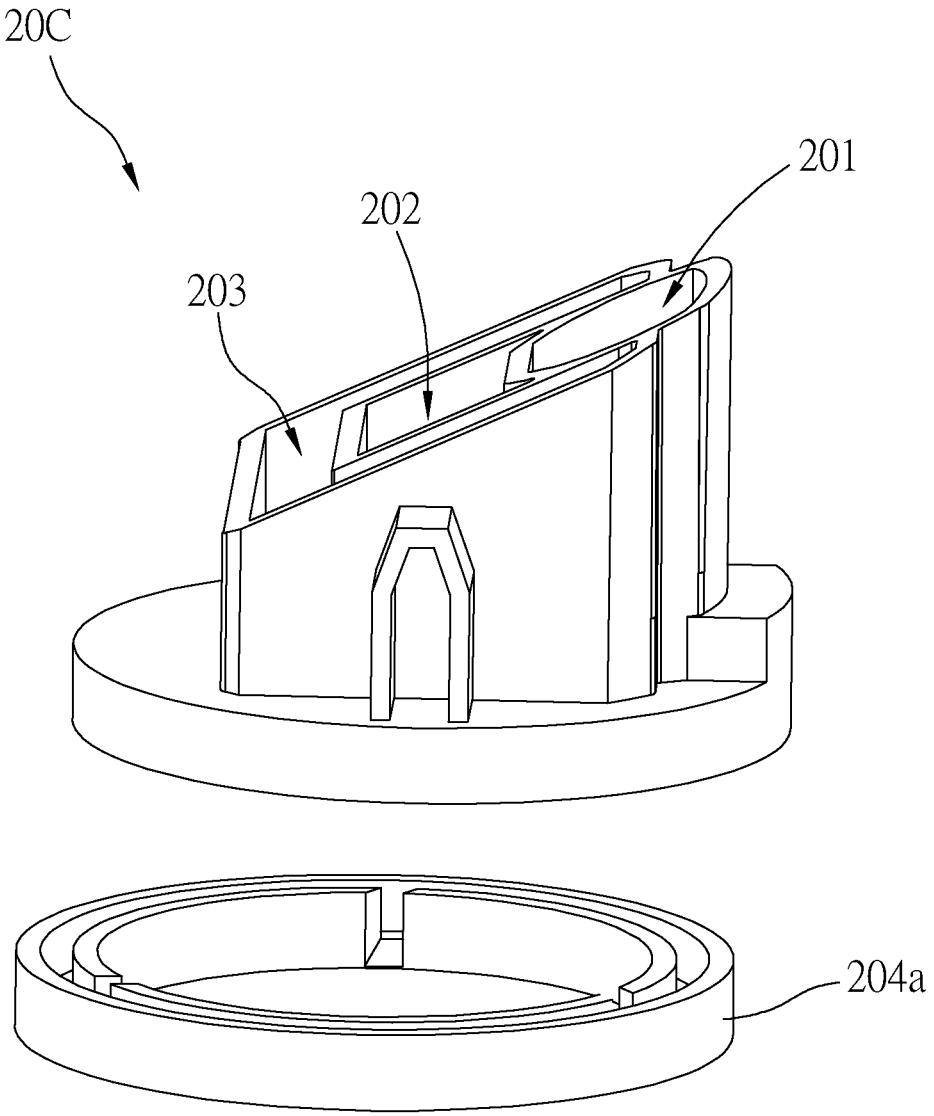
FIG. 3C is a partial cross-sectional view of the diverter of the brushing sprayer of one embodiment of the present disclosure.
Figure 4:
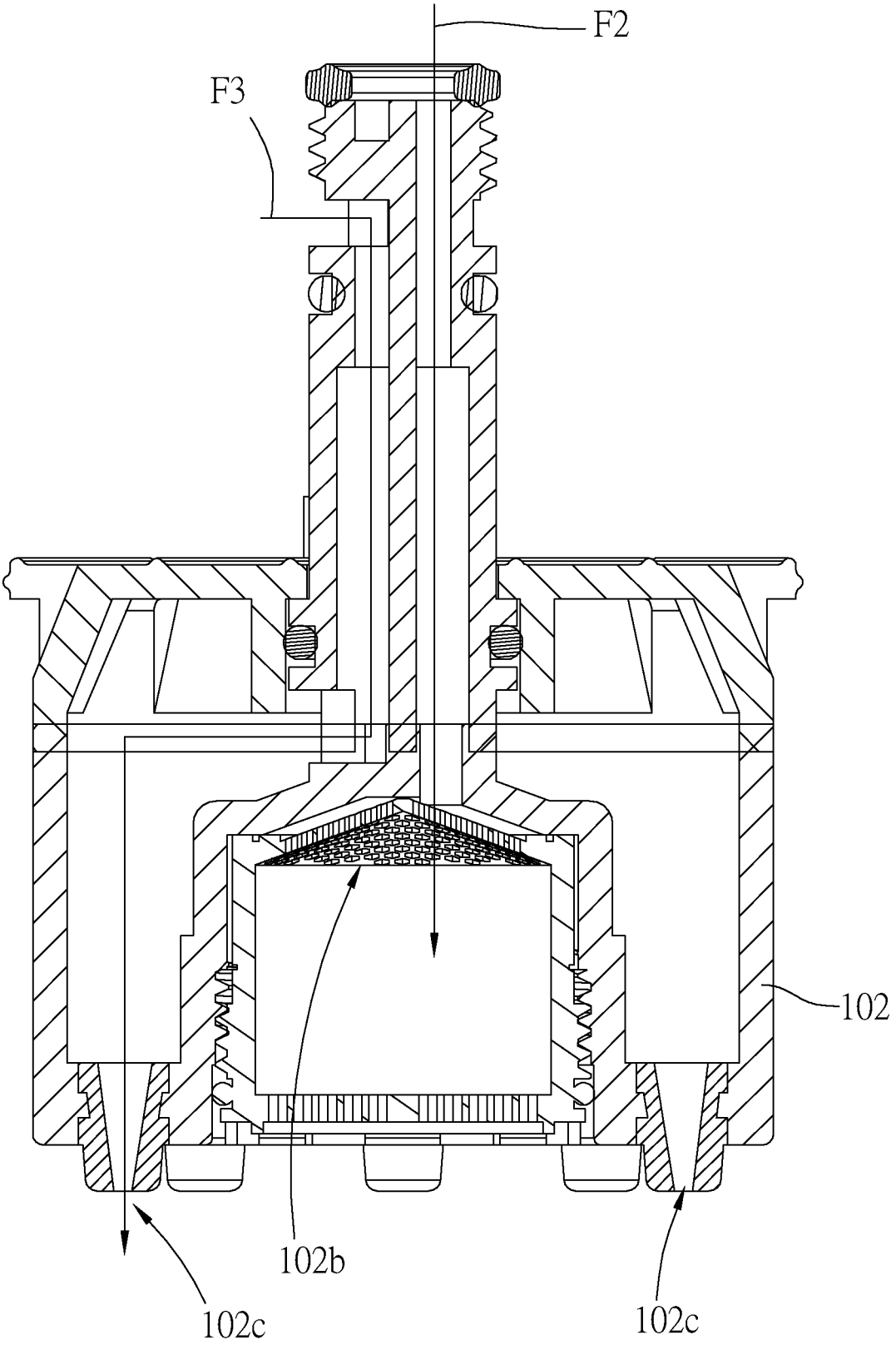
FIG. 4 is a cross-sectional view of a spraying head of the brushing sprayer of one embodiment of the present disclosure.

According to one embodiment of the present disclosure, the diverter 20 includes three parts 20A, 20B, 20C, wherein the three parts 20A, 20B, 20C could be composed to form the first flow way 201, the second flow way 202 or the third flow way 203, as shown in FIG. 3A, FIG. 3B and FIG. 3C. According to one embodiment of the present disclosure, the diverter 20 further includes a lined ring 204*a* positioned between the part 20C and the outlet end 102. According to another one embodiment of the present disclosure, the diverter 20 further includes a lined sheet 204*b* positioned between the part 20C and the outlet end 102.

The brushing head 40 is positioned on the outlet end 102 of the pipe body 10. The control assembly 30 includes a first plug 32 and a second plug 34, the first plug 32 is positioned corresponding to the first flow way 201, the second flow way 202 and the third flow way 203, and the second plug 34 is positioned corresponding to the second flow way 202 and the third flow way 203.

The diverter 20 includes a first diverting well 240 and a second diverting well 250 communicating with each other. According to one embodiment of the present disclosure, the first diverting well 240 has a first through hole 242 and a second through hole 244. The first diverting well 240 communicates with the second diverting well 250 through the second through hole 244. The first through hole 242 communicates with the first flow way 201, and the second through hole 244 communicates with the second flow way 202 and the third flow way 203.

The second diverting well 250 has a third through hole 252 and a fourth through hole 254. According to one embodiment of the present disclosure, the third through hole 252 communicates with the second flow way 202, and the fourth through hole 254 communicates with the third flow way 203.

According to one embodiment of the present disclosure, the first plug 32 correspondingly passes into the first diverting well 240 and the second plug 34 correspondingly passes into the second diverting well 250.

Figure 7:
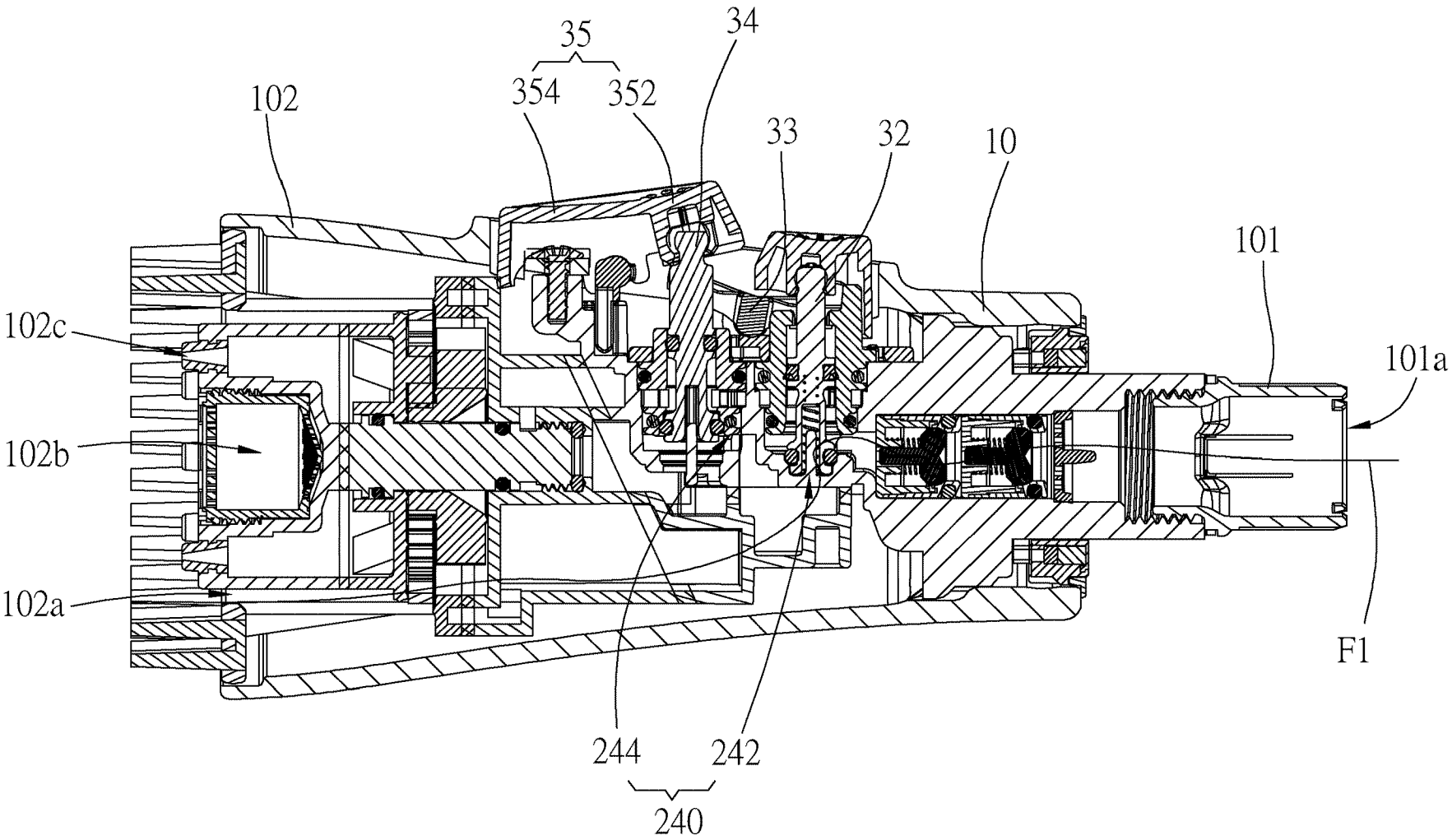
FIG. 7 is a cross-sectional view of the brushing sprayer of one embodiment of the present disclosure, wherein a bubbling function of the brushing sprayer is provided.
Figure 8:
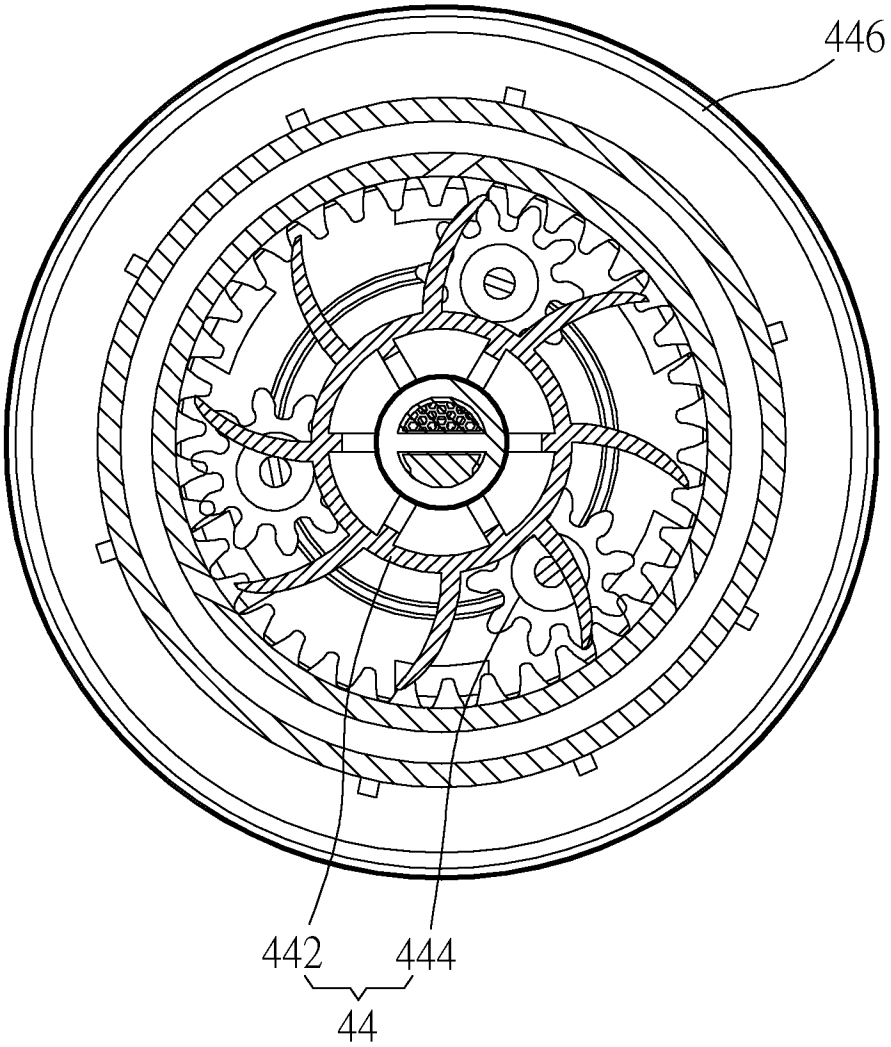
FIG. 8 is a cross-sectional view of a decelerator of the brushing sprayer of one embodiment of the present disclosure.
Figure 9:
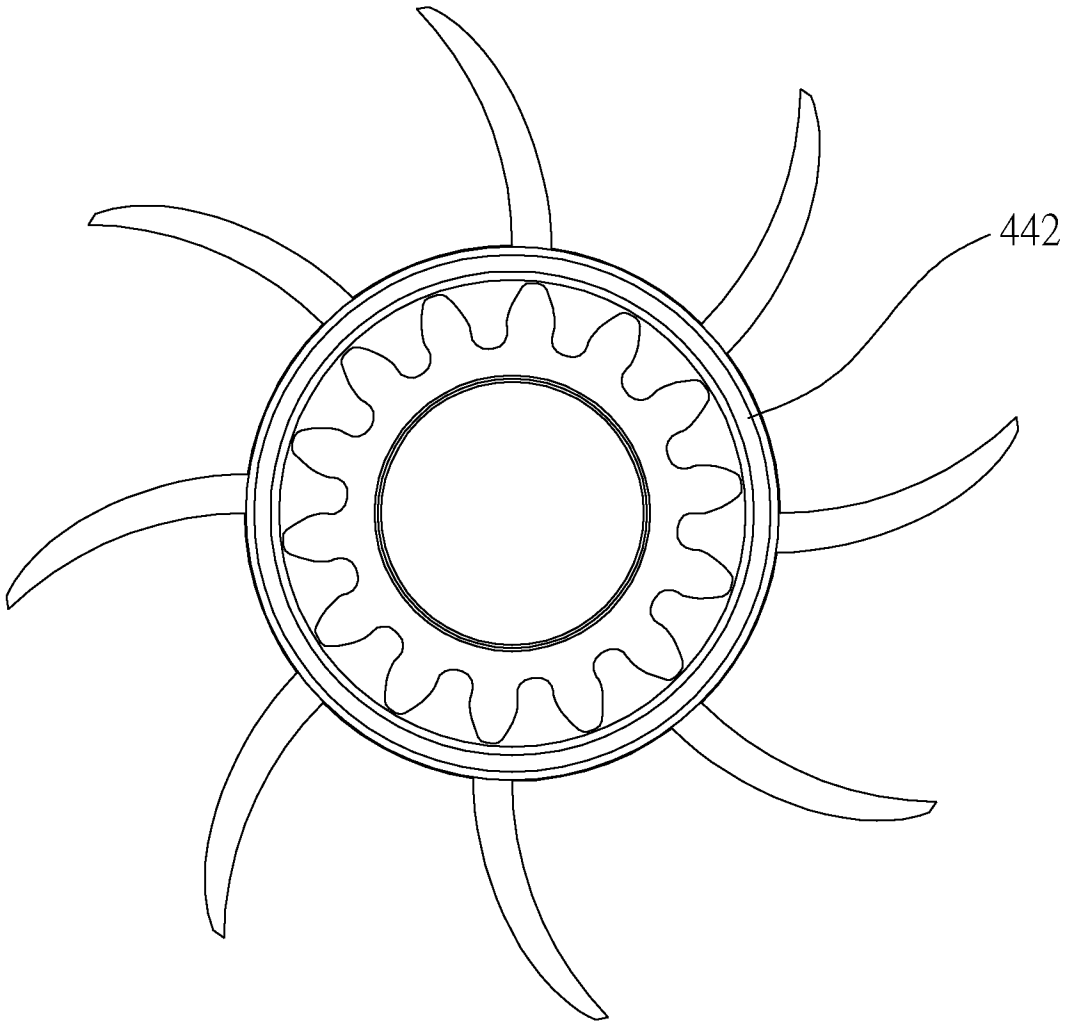
FIG. 9 is a top view of a sun gear of the decelerator of the brushing sprayer of one embodiment of the present disclosure.
Figure 10:
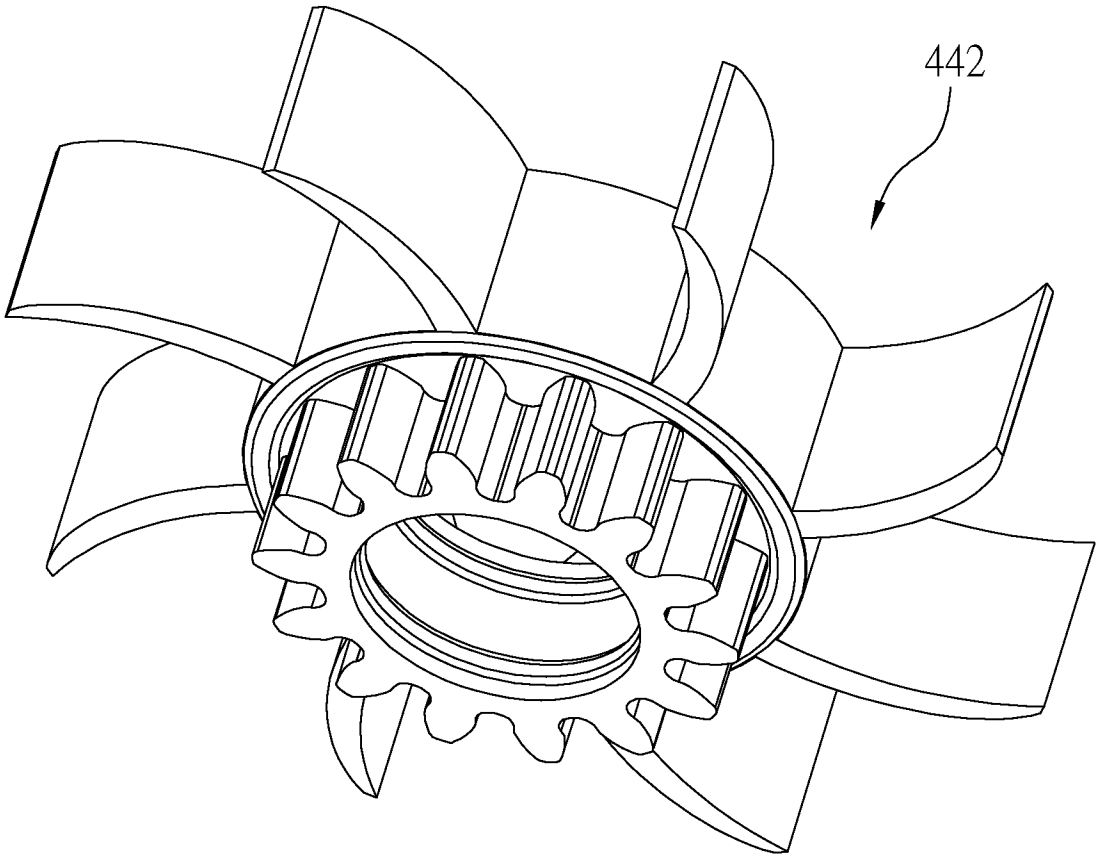
FIG. 10 is a perspective view of the sun gear of the decelerator of the brushing sprayer of one embodiment of the present disclosure.
Figure 11:
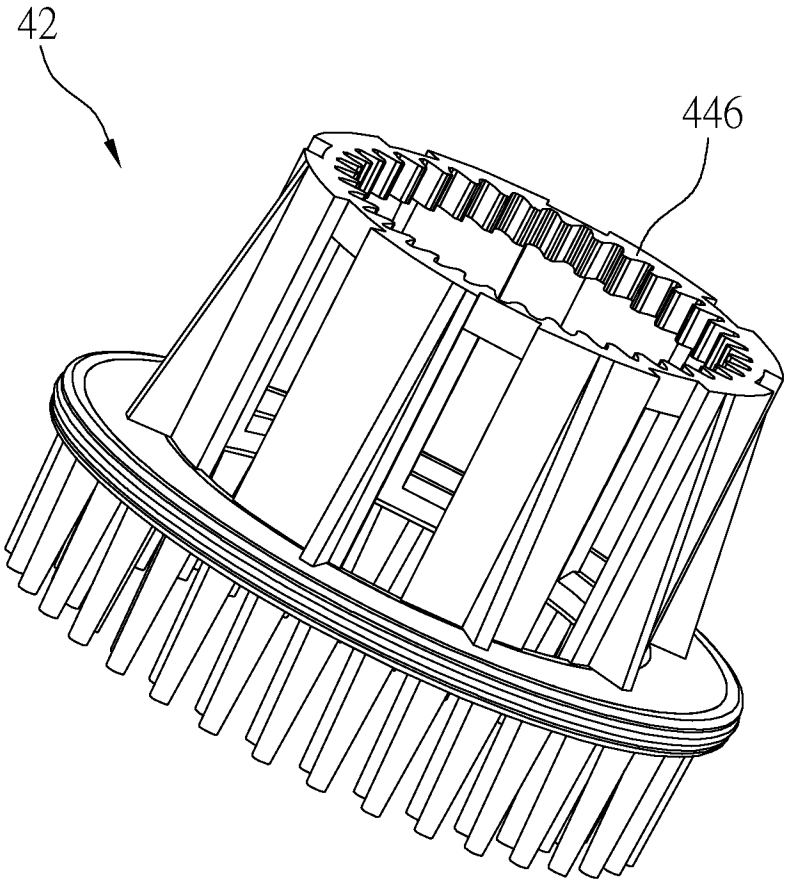
FIG. 11 is a perspective view of the brushing head of the brushing sprayer of one embodiment of the present disclosure.
Figure 12:
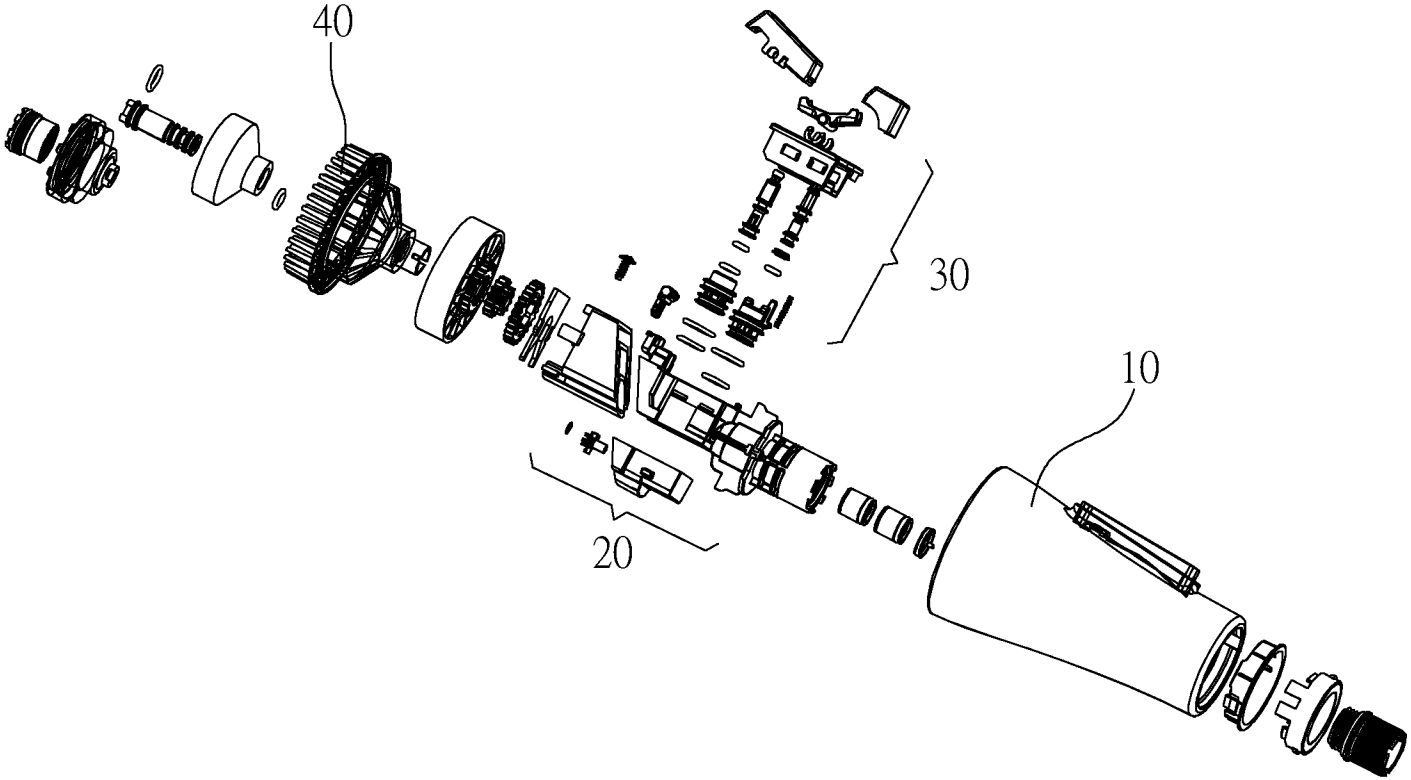
FIG. 12 is an exploded view of the brushing sprayer of another one embodiment of the present disclosure.
Figure 13:
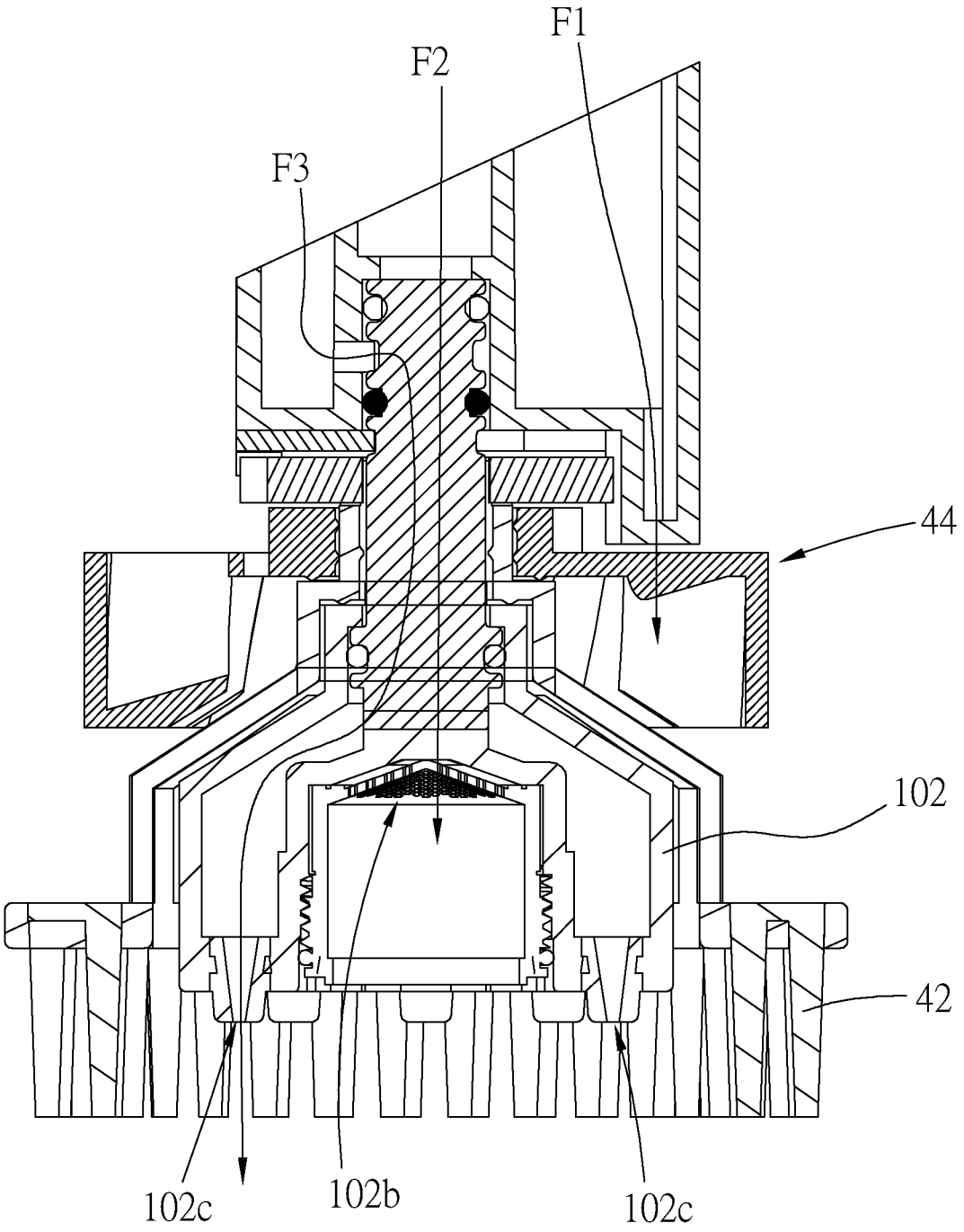
FIG. 13 is a cross-sectional view of a spraying head of the brushing sprayer of another one embodiment of the present disclosure.
Figure 14:
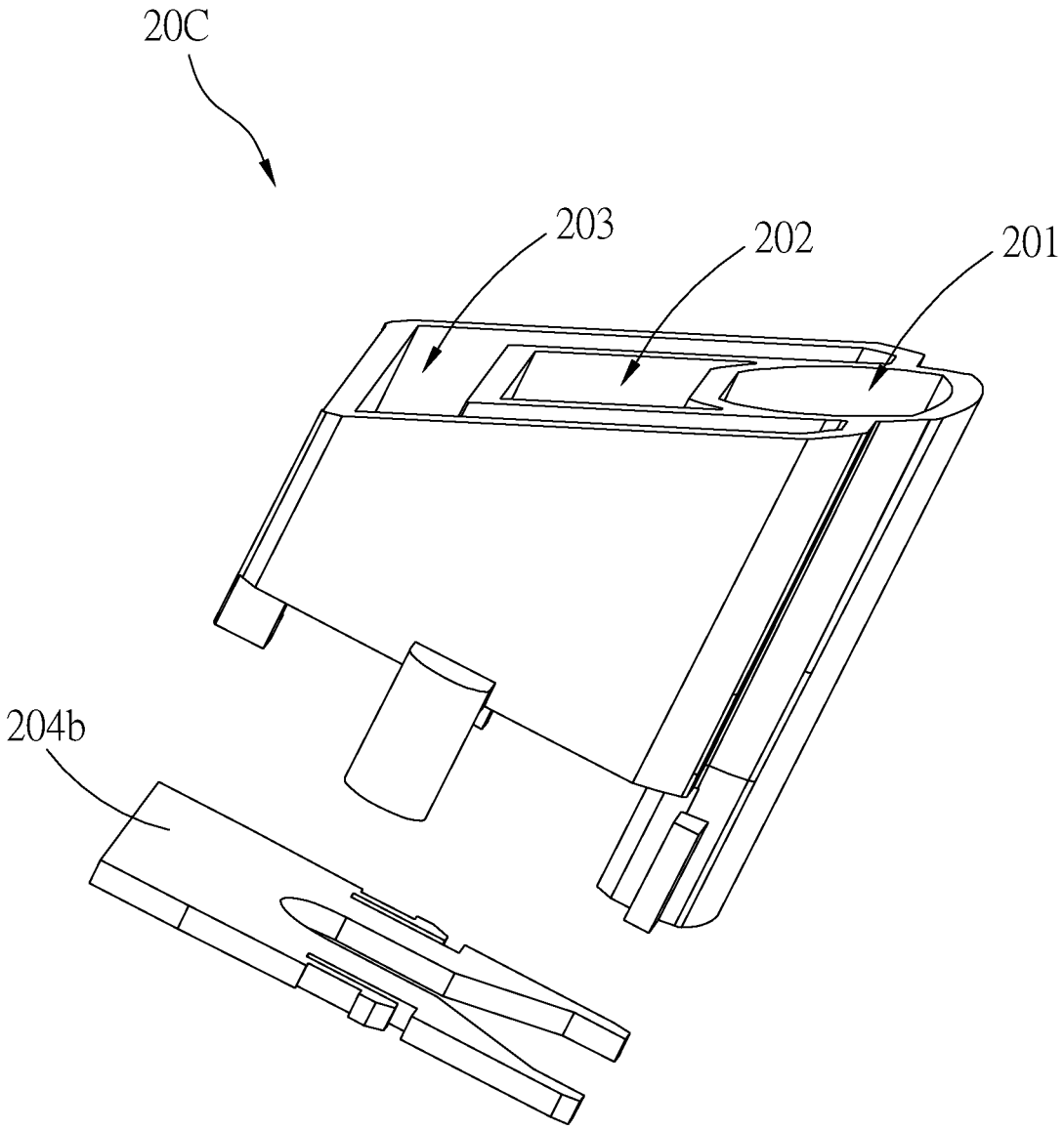
FIG. 14 is a partial cross-sectional view of the diverter of the brushing sprayer of another one embodiment of the present disclosure.
Figure 15:
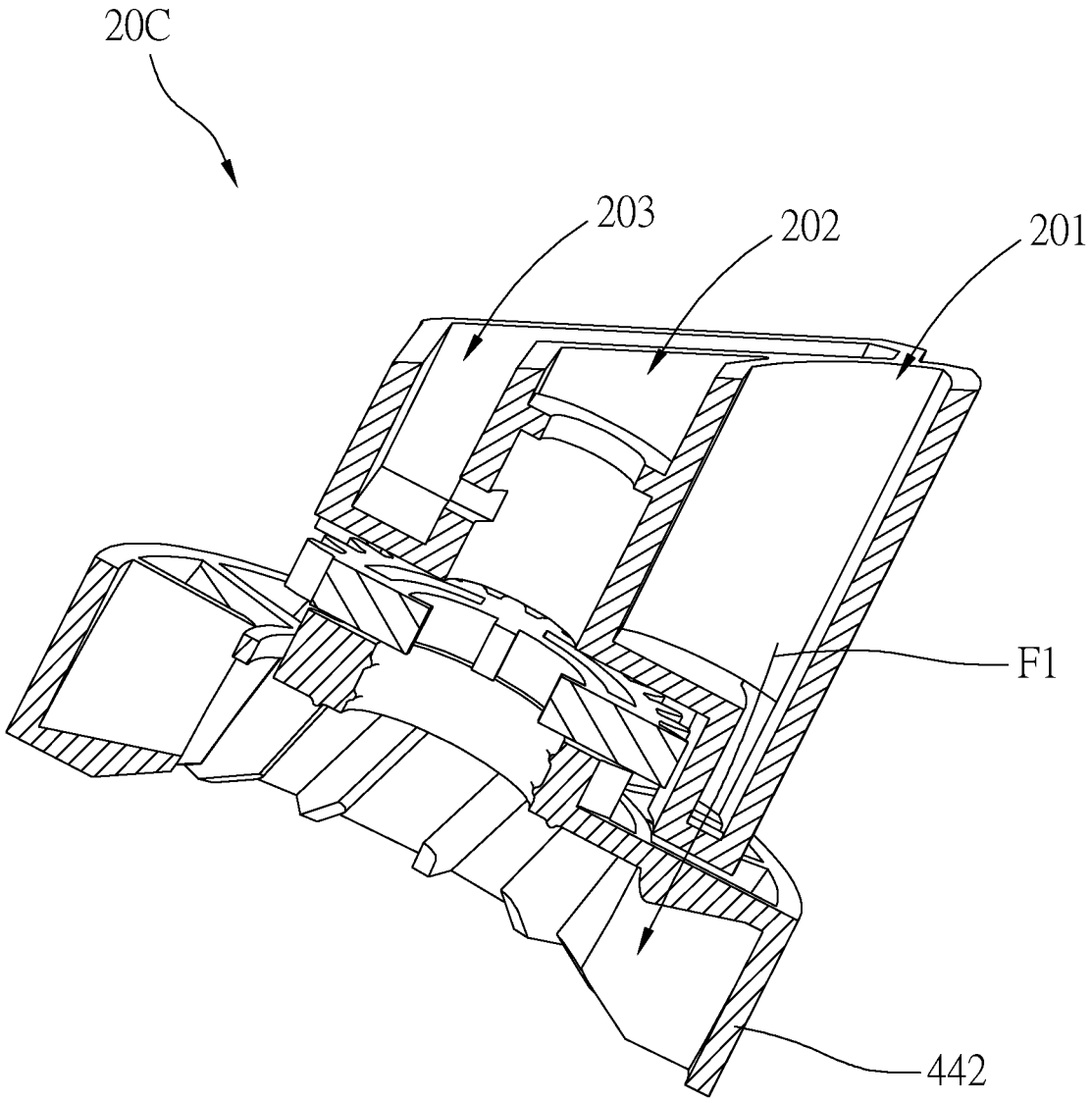
FIG. 15 is a cross-sectional view of a decelerator of the brushing sprayer of another one embodiment of the present disclosure.
Figure 16:
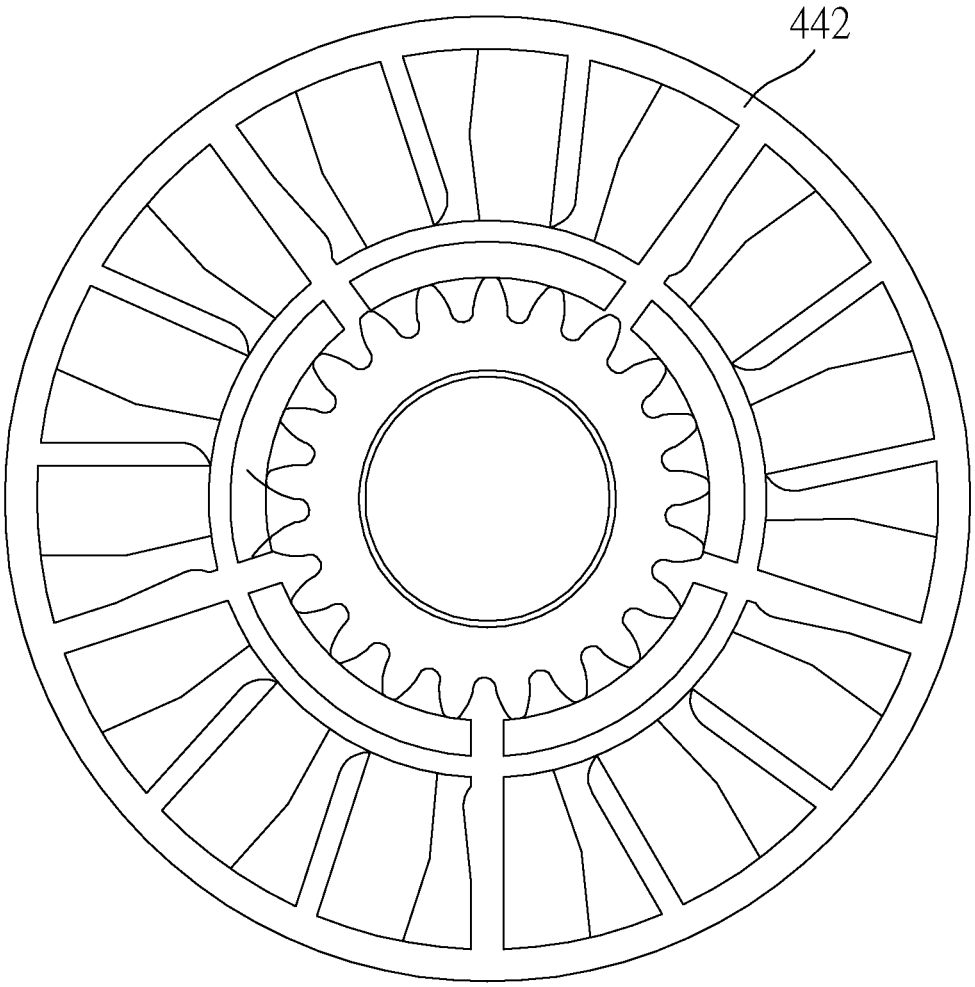
FIG. 16 is a top view of a central gear of the water power member of the brushing sprayer of another one embodiment of the present disclosure.
Figure 17:
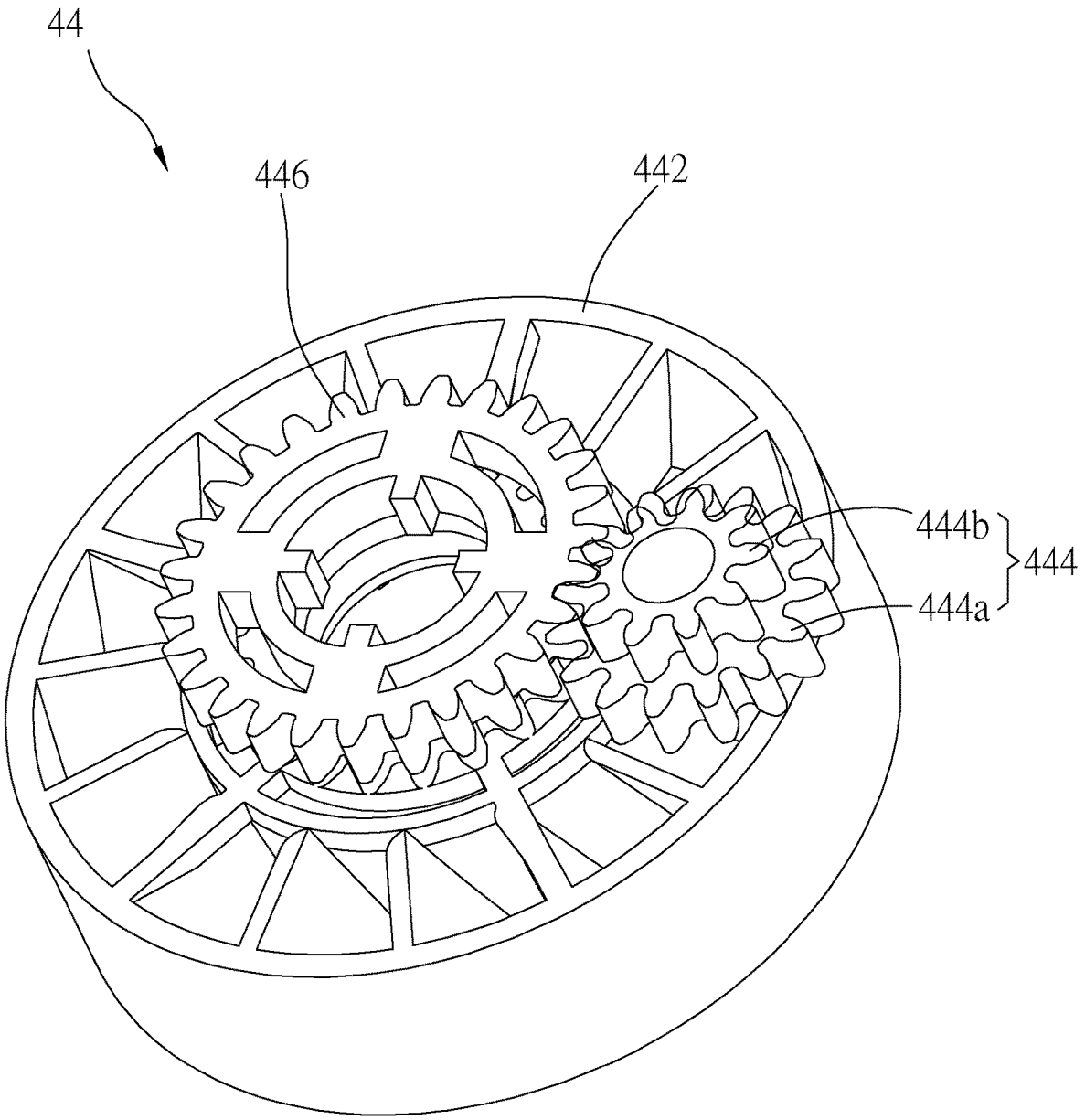
FIG. 17 is a perspective view of the central gear of the water power member of the brushing sprayer of one embodiment of the present disclosure.

According to one embodiment of the present disclosure, when the control assembly 30 plugs the second flow way 202 and the third flow way 203, the water flow F1 outlets from the first flow way 201, as shown in FIG. 7. In the other words, when the first plug 32 does not plug the first flow way 201, the first plug 32 plugs the second flow way 202 and the third flow way 203, whereby the water flow F1 outlets from the first flow way 201.

In detail, when the first plug 32 plugs the second through hole 244 of the first diverting well 240, the water flow F1 outlets from the first flow way 201 through the first through hole 242 of the first diverting well 240.

Figure 5:
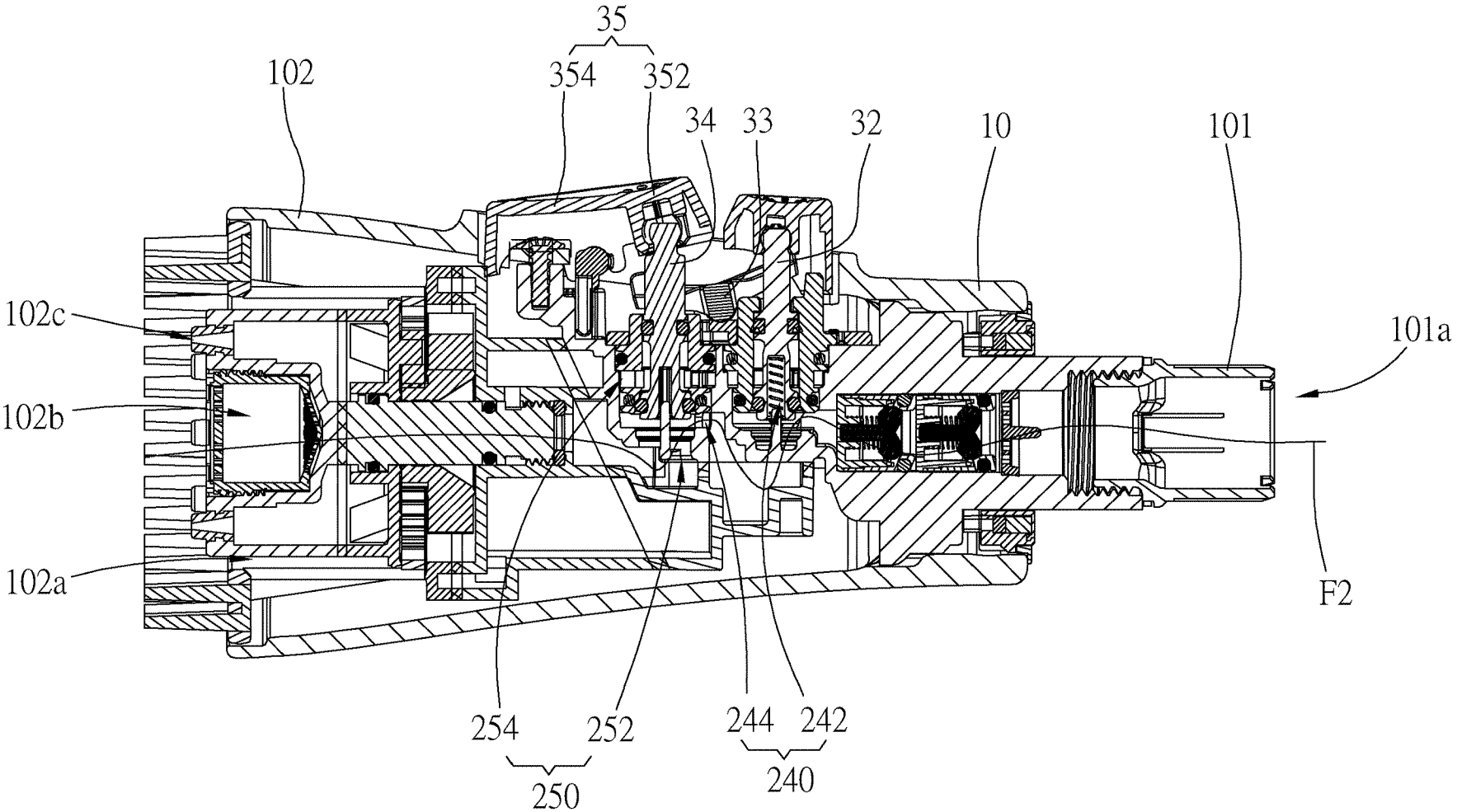
FIG. 5 is a cross-sectional view of the brushing sprayer of one embodiment of the present disclosure, wherein a rinsing function of the brushing sprayer is provided.

According to one embodiment of the present disclosure, when the control assembly 30 plugs the first flow way 201 and the third flow way 203, the water flow F2 outlets from the second flow way 202, as shown in FIG. 5. In the other words, when the first plug 32 plugs the first flow way 201, and the second plug 34 plugs the third flow way 203, the water flow F2 outlets from the second flow way 202.

In detail, when the first plug 32 plugs the first through hole 242 of the first diverting well 240, and the second plug 34 plugs the fourth through hole 254 of the second diverting well 250, the water flow F2 outlets from the second flow way 202 through the third through hole 252 of the second diverting well 250.

Figure 6:
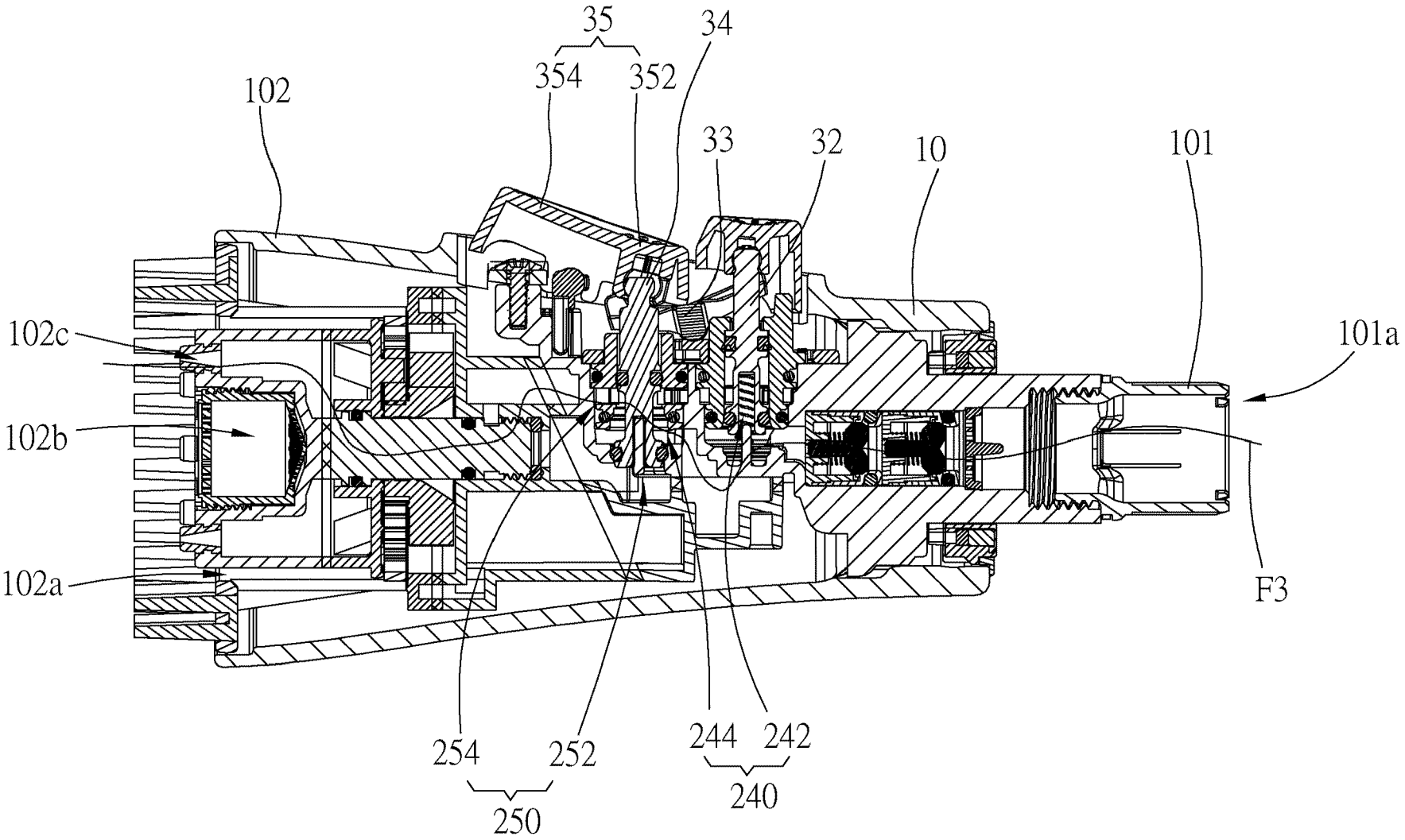
FIG. 6 is a cross-sectional view of the brushing sprayer of one embodiment of the present disclosure, wherein a spraying function of the brushing sprayer is provided.

According to one embodiment of the present disclosure, when the control assembly 30 plugs the first flow way 201 and the second flow way 202, the water flow F3 outlets from the third flow way 203, as shown in FIG. 6. In the other words, when the first plug 32 plugs the first flow way 201, and the second plug 34 plugs the second flow way 202, the water flow F3 outlets from the third flow way 203.

In detail, the first plug 32 plugs the first through hole 242 of the first diverting well 240, and the second plug 34 plugs the third through hole 252 of the second diverting well 250, the water flow F3 outlets from the third flow way 203 through the fourth through hole 254 of the second diverting well 250.

According to one embodiment of the present disclosure, the control assembly 30 includes a linked structure 33. The linked structure 33 is connected to the first plug 32 and the second plug 34. According to one embodiment of the present disclosure, first plug 32 is connected to one end of the linked structure 33 while the second plug 34 is connected to the other one end of the linked structure 33. When the first plug 32 plugs the first through hole 244 of the first diverting well 240, the second plug 34 is driven by the first plug 32 to plug the fourth through hole 254 of the second diverting well 252.

When the first plug 32 plugs the first through hole 242 of the first diverting well 240, and the second pressed portion 354 of the pressed member 35 is pressed, the first pressed portion 352 pulls the second plug 34 to plug the fourth through hole 254 of the second diverting well 250, whereby the water flow F2 outlets from the second flow way 202.

Referring to FIG. 8 to FIG. 11, the brushing head 40 includes a brushing portion 42 and a rotating assembly 44. According to one embodiment of the present disclosure, the rotating portion 44 is positioned in the pipe body 10. The brushing portion 42 and the rotating assembly 44 are connected to each other. When the rotating assembly 44 rotates, the rotating assembly 44 drives the brushing portion 42 to rotate. According to one embodiment of the present disclosure, the brushing portion 42 and the rotating assembly 44 are detachably connected to each other.

According to one embodiment of the present disclosure, the rotating assembly 44 includes a water power member 442. The water power member 442 is positioned on the first flow way 201. When the water flow F1 flows through the water power member 442 along the first flow way 201, the water flow F1 drives the water power member 442 to rotate, and drives the brushing portion 42 to rotate simultaneously.

According to one embodiment of the present disclosure, the rotating assembly 44 is a planetary gear decelerator 44. The water power member 442 is a sun gear 442 of the planetary gear decelerator 44, and the brushing portion 42 is connected to a driven gear 446 of the dual gear decelerator 44. According to one embodiment of the present disclosure, a planetary gear carrier 444 is positioned between the water power member 442 and the brushing portion 42. When the sun gear 442 rotates, the sun gear 442 transmits a rotation force to the ring wheel 446 through the planetary gear carrier 444, whereby to rotate the ring wheel 446, so as to drive the brushing portion 42 to rotate.

Referring to FIG. 13, FIG. 15 to FIG. 17, the brushing head 40 includes a brushing portion 42 and a rotating assembly 44. According to one embodiment of the present disclosure, the rotating portion 44 is positioned in the pipe body 10. The brushing portion 42 and the rotating assembly 44 are connected to each other. When the rotating assembly 44 rotates, the rotating assembly 44 drives the brushing portion 42 to rotate. According to one embodiment of the present disclosure, the brushing portion 42 and the rotating assembly 44 are detachably connected to each other.

According to one embodiment of the present disclosure, the rotating assembly 44 includes a water power member 442. The water power member 442 is positioned on the first flow way 201. When the water flow F1 flows through the water power member 442 along the first flow way 201, the water flow F1 drives the water power member 442 to rotate, and drives the brushing portion 42 to rotate simultaneously.

According to one embodiment of the present disclosure, the rotating assembly 44 is a dual gear decelerator 44. The water power member 442 is a fan gear 442 of the dual gear decelerator 44, and the brushing portion 42 is connected to a driven gear 446. According to one embodiment of the present disclosure, a dual gear assembly 444 is positioned between the water power member 442 and the brushing portion 42. When the fan gear 442 rotates, the fan gear 442 transmits a rotation force to the driven gear 446 through the dual gear assembly 444, whereby to rotate the driven gear 446, so as to drive the brushing portion 42 to rotate.

Figure 18:
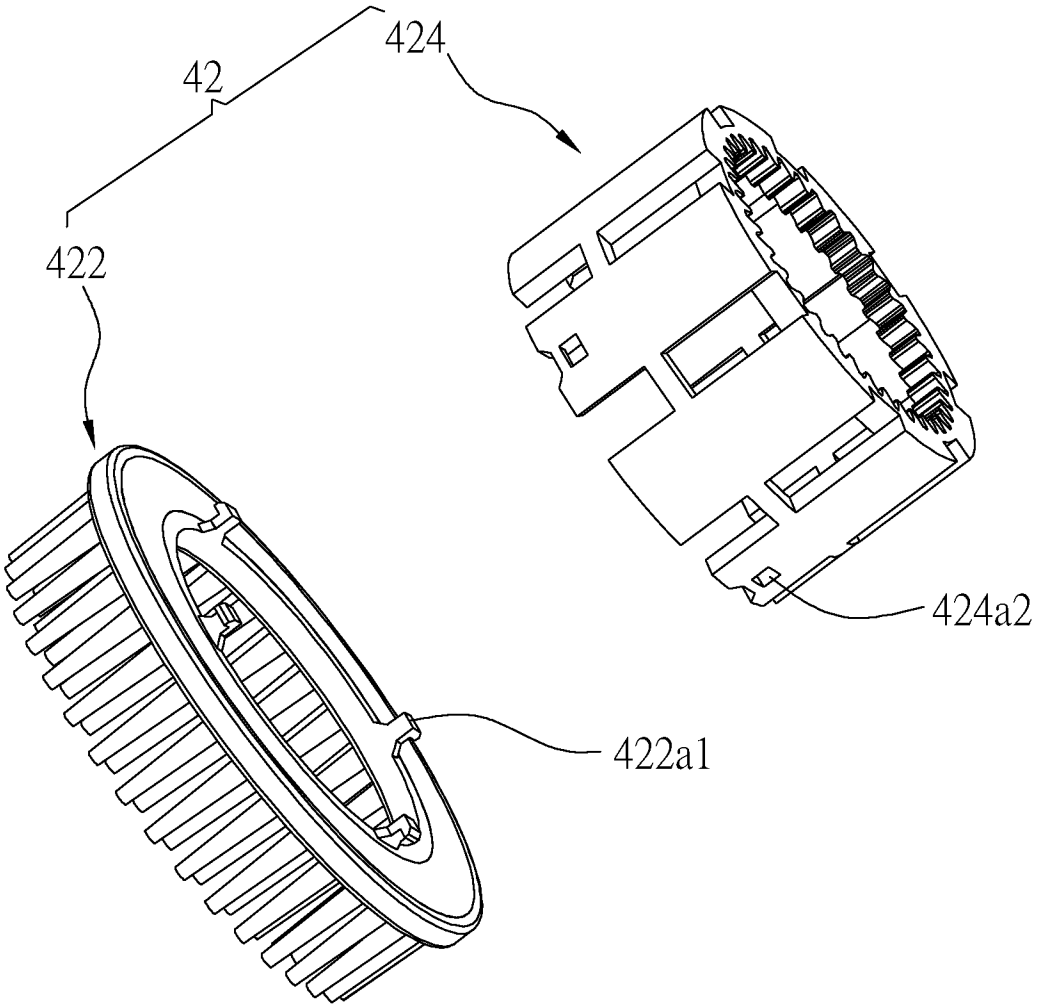
FIG. 18 is an exploded view of the brushing portion of the brushing head of the brushing sprayer of one embodiment of the present disclosure.
Figure 19:
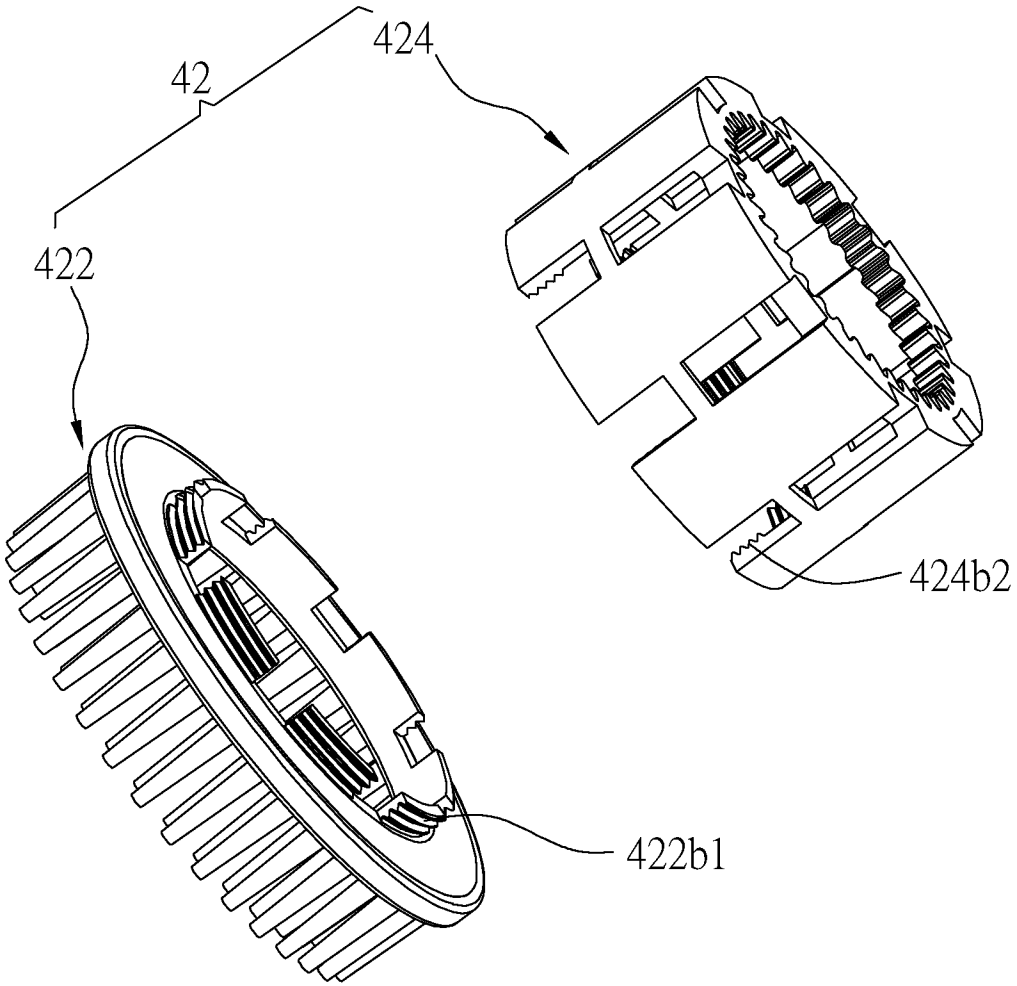
FIG. 19 is an exploded view of the brushing portion of the brushing head of the brushing sprayer of one embodiment of the present disclosure.

Referring to FIG. 18 and FIG. 19, the brushing portion 42 includes a brushing pad 422 and a support 424, wherein the brushing pad 422 and the support 424 are detachably connected to each other. According to one embodiment of the present disclosure, the brushing pad 422 and the support 424 are detachably connected in a snap-fit connection, as shown in FIG. 18. According to one embodiment of the present disclosure, the brushing pad 422 and the support 424 are detachably connected in a threaded connection, as shown in FIG. 19.

In FIG. 18, the brushing pad 422 includes a plurality of hooks 422*a*1, and the support 424 includes a plurality of connection holes 422*a*2, whereby the brushing pad 422 and the support 424 could be detachably connected in a snap-fit connection while each of the hooks 422*a*1 is snap-fitted to corresponding one of the connection holes 422*a*2.

In FIG. 19, the brushing pad 422 includes an external thread 422*b*1, and the support 424 includes an internal thread 422*b*2, whereby the brushing pad 422 and the support 424 could be detachably connected in a threaded connection while the external thread 422*b*1 is threaded to the internal thread 422*b*2.

It must be pointed out that the embodiments described above are only some preferred embodiments of the present disclosure. All equivalent structures which employ the concepts disclosed in this specification and the appended claims should fall within the scope of the present disclosure.

What is claimed is:

1. A brushing sprayer, comprising:

a pipe body, comprising an inlet end and an outlet end, wherein the inlet end has an inlet opening, and the outlet end has a first outlet opening, a second outlet opening and a third outlet opening, the inlet opening, the first outlet opening, the second outlet opening and the third outlet opening communicate with each other;

a diverter, positioned in the pipe body, and comprising a first flow way, a second flow way and a third flow way communicating with each other, wherein the first flow way, the second flow way and the third flow way communicate with the inlet opening, the first outlet opening, the second outlet opening and the third outlet opening;

a control assembly, passing through the pipe body, and connected to the diverter; the control assembly is adapted to plug two selected from a group consisting of the first flow way, the second flow way and the third flow way, whereby a water flow could be regulated by the control assembly to outlet from the first flow way, the second flow way or the third flow way; and a brushing head, positioned on the outlet end of the pipe body, wherein the control assembly comprises a first plug and a second plug, the first plug is positioned corresponding to the first flow, the second flow way and the third flow way, and the second plug is positioned corresponding to the second flow way and the third flow way, and wherein the diverter comprises a first diverting well and a second diverting well communicating with each other, the first diverting well has a first through hole and a second through hole, the first diverting well communicates with the second diverting well through the second through hole, the first through hole communicates with first flow way, and the second through hold communicates with the second flow way and the third flow way; the second diverting well has a third through hole and a fourth through hole, the third through hole communicates with the second flow ay, and the fourth through hole communicates with the third flow way.

2. The brushing sprayer of claim 1, wherein when the control assembly plugs the second flow way and the third flow way, the water flow outlets from the second flow way.

3. The brushing sprayer of claim 1, wherein when the control assembly plugs the first flow way and the second flow way, the water flow outlets from the third flow way.

4. The brushing sprayer of claim 1, wherein when the control assembly plugs the first flow way and the second flow way, the water flow outlets from the third flow way.

5. The brushing sprayer of claim 1, wherein when the first plug plugs the first flow way, and the second plug plugs the second flow way, the water flow outlets from the third flow way.

6. The brushing sprayer of claim 1, wherein when the first plug plugs the first flow way, and the second plug plugs the third flow way, the water flow outlets from the second flow way.

7. The brushing sprayer of claim 1, wherein when the first plug does not plug the first flow way, the first plug plugs the second flow way and the third flow way, whereby the water flow outlets from the first flow way.

8. The brushing sprayer of claim 1, wherein the first plug correspondingly passes into the first diverting well, and the second plug correspondingly passes into the second diverting well.

9. The brushing sprayer of claim 8, wherein when the first plug plugs the first through hole of the first diverting well, and the second plug plugs the third through hole of the second diverting well, the water flow outlets from the third flow way.

10. The brushing sprayer of claim 8, wherein when the first plug plugs the first through hole of the first diverting well, and the second plug plugs the fourth through hole of the second diverting well, the water flow outlets from the second flow way.

11. The brushing sprayer of claim 8, wherein when the first plug plugs the second through hole of the first diverting well, the water flow outlets from the first flow way.

12. The brushing sprayer of claim 8, wherein the control assembly comprises a linked structure connected to the first plug and the second plug, when the first plug plugs the first through hole of the first diverting well, the second plug is driven by the first plug to plug the fourth through hole of the second diverting well.

13. The brushing sprayer of claim 1, wherein the brushing head comprises a brushing portion and a rotating assembly, the rotating assembly is positioned in the pipe body, the brushing portion and the rotating assembly are connected to each other, and when the rotating assembly rotates, the rotating assembly drives the brushing portion to rotate.

14. The brushing sprayer of claim 13, wherein the rotating assembly comprises a water power member, the water power member is positioned on the first flow way; when the water flow flows through the water power member along the first flow way, the water flow drives the water power member to rotate, and drives the brushing portion to rotate simultaneously.

15. The brushing sprayer of claim 14, wherein the rotating assembly is a planetary gear decelerator, the water power member is a sun gear of the planetary gear decelerator, and the brushing portion is connected to a ring wheel of the planetary gear decelerator; a planetary gear carrier is positioned between the water power member and the brushing portion; when the sun gear rotates, the sun gear transmits a rotation force to the ring wheel through the planetary gear carrier, whereby to rotate the ring wheel, so as to drive the brushing portion to rotate.

16. The brushing sprayer of claim 14, wherein the rotating assembly is a dual gear decelerator, the water power member is a fan gear of the dual gear decelerator, and the brushing portion is connected to a driven gear of the dual gear decelerator; a dual gear assembly is positioned between the water power member and the brushing portion; when the fan gear rotates, the fan gear transmits a rotation force to the driven gear through the dual gear assembly, whereby to rotate the driven gear, so as to drive the brushing portion to rotate.

17. The brushing sprayer of claim 13, wherein the brushing portion comprises a brushing pad and a support, the brushing pad and the support are detachably connected to each other.

18. The brushing sprayer of claim 17, wherein the brushing pad and the support are detachably connected in a snap-fit connection or in a threaded connection.

* * * * *